United States Patent [19]

Kaulig et al.

[11] Patent Number: 4,624,025

[45] Date of Patent: Nov. 25, 1986

[54] PROTECTIVE DEVICE FOR FLOOR CLEANING APPARATUS

[75] Inventors: Heinz Kaulig; Klaus Stein, both of Velbert, Fed. Rep. of Germany

[73] Assignee: Stein & Co. GmbH, Velbert, Fed. Rep. of Germany

[21] Appl. No.: 608,621

[22] Filed: May 9, 1984

[30] Foreign Application Priority Data

May 21, 1983 [DE] Fed. Rep. of Germany ..... 3318604

[51] Int. Cl.[4] ..... A47L 11/32

[52] U.S. Cl. ..... 15/41 R; 15/49 R; 15/384

[58] Field of Search ..... 15/41 R, 48, 49 C, 50 C, 15/378, 383, 384

[56] References Cited

U.S. PATENT DOCUMENTS 2,842,788 7/1958 Rench et al. ..... 15/48

FOREIGN PATENT DOCUMENTS 1179898 2/1970 United Kingdom .
1313580 4/1973 United Kingdom .
1337057 11/1973 United Kingdom .
1358177 6/1974 United Kingdom .

*Primary Examiner*—Edward L. Roberts
*Attorney, Agent, or Firm*—John C. Smith, Jr.

[57] ABSTRACT

A protective device for floor cleaning apparatus with a rotating driving source and with brush rollers driven thereby comprises a housing 2 with a bottom wall on its side facing towards the floor. The bottom wall is provided with working apertures 9 for the brush rollers and with tooth-shaped carpet deflectors which project on the side on which the bristles of the brush rollers enter the housing from the bottom wall into the working apertures.

2 Claims, 6 Drawing Figures

PROTECTIVE DEVICE FOR FLOOR CLEANING APPARATUS

BACKGROUND OF THE INVENTION

This invention relates to a protective device for floor cleaning apparatus with a rotating driving source and with two rotating brush rollers driven thereby.

Various different processes are employed for the cleaning of textile floor coverings. In the main they are classified as "wet" processes, e.g. "spray extraction", on the one hand, and the so-called dry cleaning processes on the other. These latter are by far the most problem-free methods for the layman, as the risk of puckering due to excessive wetting cannot occur. The dry cleaning of textile floor coverings is effected with a powder containing not only detergents but also solvents and other ingredients. Floor processing machines with rotating foam plastic rollers or brush rollers are used for the purpose of working this powder into the pile of the carpet, so that it can take effect therein.

Already known apparatus of this kind are made, for example, by Vorwerk (Federal Republic of Germany), Host (U.S.A.) and Certified (U.S.A.). The two latter each operate with two brush rollers rotating in opposite directions. These are extremely efficient, i.e. penetrate the pile to an ample depth and clean the fibers from all sides. However, the possibility has to be faced, as in all brush rollers rotating in a housing, that corners or edges of the carpet will be pushed into the housing by the brush rollers and thus suffer damage. This would also choke the floor cleaning apparatus and possibly damage it.

In order to avoid this the customary apparatus has been fitted with protective devices in the form of guard grids which extend across the brush rollers on the side of the latter which is in contact with the floor. These protective grids suffer from serious drawbacks, which reside in the fact that in the first place it is far more difficult to clean and replace the brush rollers, while in the second place the cost of manufacturing and assembling the apparatus is greatly increased. When the brush rollers have to be cleaned and replaced, the protective devices first have to be removed. The protective bars extending across the brush rollers impede operation from yet a further point of view: the bristles on the brush rollers have to be interrupted at the point in question, so that "streaks" are left on the carpet where the roller has "missed" it. Such apparatus therefore fails to ensure maximum evenness in the "raising" of the pile and in the cleaning of the carpeted floor.

SUMMARY OF THE INVENTION

It is the object of the present invention to avoid the aforementioned drawbacks in a surprisingly simple, economical and effective manner.

To attain this object the present invention provides a protective device for floor cleaning apparatus with a rotating driving source and with rotating brush rollers driven thereby, comprising a housing for the floor cleaning apparatus which on its side facing towards the floor is provided with working apertures for the brush rollers, and tooth-shaped carpet deflectors provided in the working apertures at locations at which the bristles of the brush rollers enter the interior of the housing of the floor cleaning apparatus when it is in operation.

By thorough research in this field it has been found that it is not necessary to provide a guard grid in front of the entire brush rollers. It is fully sufficient for protective devices taking the form of carpet deflectors to be provided on that side of the brush rollers on which the bristles are caused by the direction of rotation to enter the housing. As a result of this important discovery the protective bars extending across the brush rollers were abandoned in favor of carpet deflectors provided on one side only in the housing. As these carpet deflectors can be made in one piece with the housing or with a part by which it is covered, such as its base, the cost is considerably reduced. This offers also the functional advantage that the row of bristles on the brush rollers can continue without a break, as these carpet deflectors are so constructed that they only press the bristles apart when they are rotating in the immediate zone of the deflectors, after which the tufts of bristles close up again. No unbrushed streaks can therefore be produced on the carpet.

A further advantage is obtained as a result of the fact that the dismantling of the brush rollers is a very simple operation, as it is not impeded by the deflectors. There is thus no guard grid that first has to be removed.

BRIEF DESCRIPTION OF THE DRAWINGS

An embodiment of the invention will now be described by way of example and with reference to the accompanying drawings in which.

DESCRIPTION OF THE PREFERRED EMBODIMENT

Figure 1:
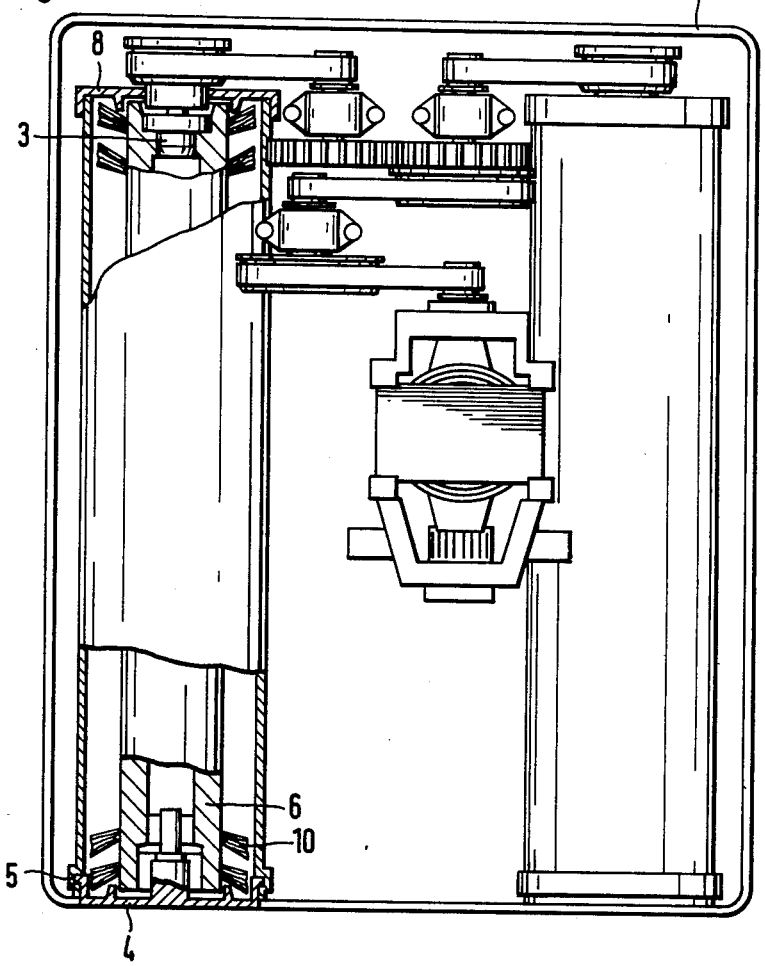
FIG. 1 is a plan view of a floor cleaning apparatus opened up.
Figure 3:
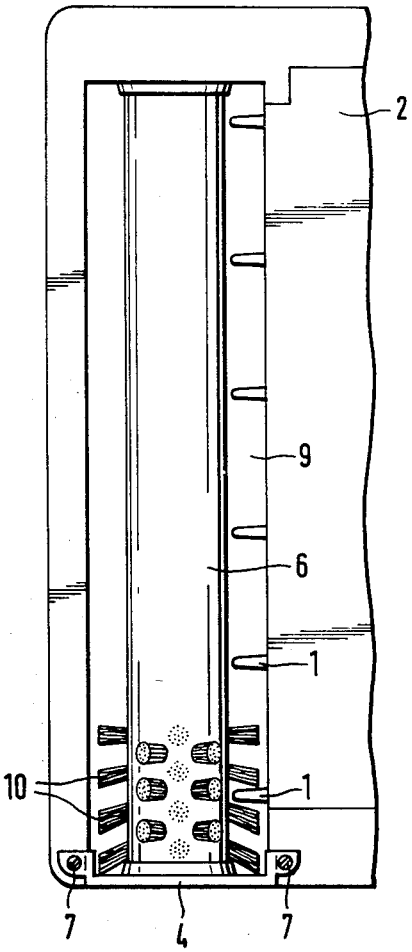
FIG. 3 is a view from underneath of the floor cleaning apparatus.
Figure 4:
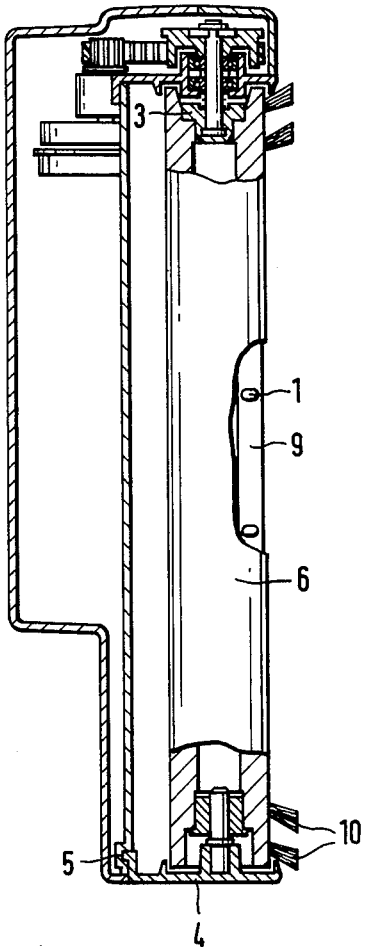
FIG. 4 is a longitudinal section through the floor cleaning apparatus.
Figure 5:
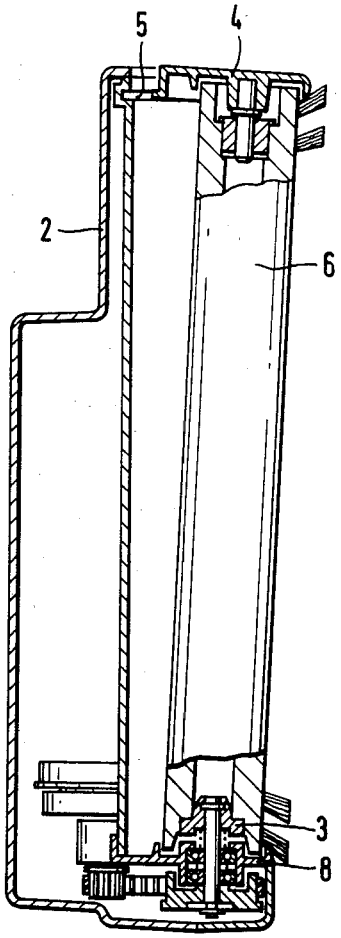
FIGS. 5 and 6 illustrate the removal of a brush roller.
Figure 6:
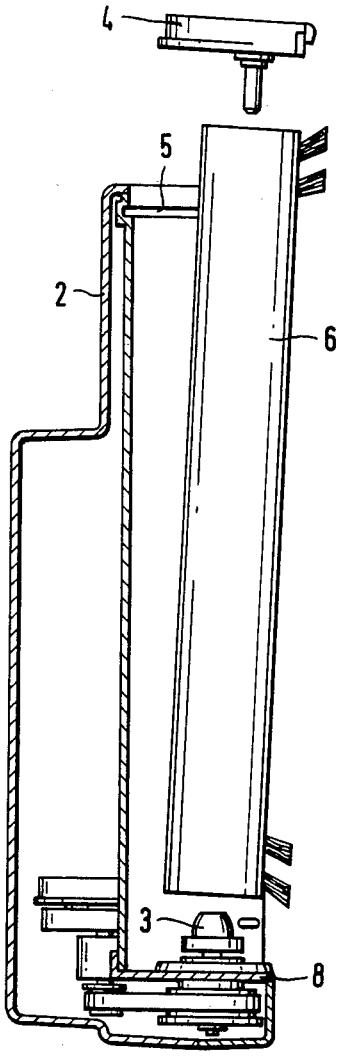

FIG. 1 shows a floor cleaning apparatus with brush rollers 6 in the operating state. The brush rollers 6 are secured in position in a housing 2 of the floor cleaning apparatus by bearings 4 and 8. After the removal of securing elements, such as screws 7, the bearing 4 is pivoted out of the housing 2 and the bearing 4 and the brush rollers 6 are pulled upwards out of the housing 2.

The parts are reinserted by the converse sequence of operations. Each brush roller 6 is placed in a slanting position on an entrainment piece 3 provided on the side of the drive, after which the bearing 4 is fitted onto the brush roller, which is pressed into appropriate guides 5 of the housing 2 and secured in position. As the entrainment piece 3 is made partly spherical, the brush roller 6 is enabled to assume the oblique position required for these insertion and removal operations.

Figure 2:
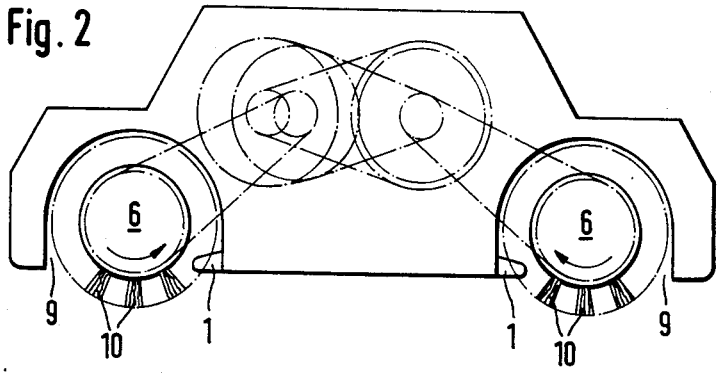
FIG. 2 is a side elevational view of the opened floor cleaning apparatus.

Carpet deflectors 1 are positioned on the floor cleaning apparatus housing 2, at the side facing towards the carpeted floor, in the working apertures 9 for the brush rollers 6, and are firmly connected to the housing 2. In accordance with the direction of rotation of the brush rollers 6 (see FIG. 2) the carpet deflectors 1 are positioned on that side of the working aperture 9 on which the bristles 10 of the brush rollers 6 enter the interior of the housing 2 of the floor cleaning apparatus and are of tooth-shaped construction and distributed over the entire length of the working apertures 9. The carpet deflectors 1 only extend into the working apertures 9 of the brush rollers 6 to the distance required to ensure that these latter can be extracted or inserted without being impeded by the carpet deflectors 1. It is thus possible for the carpet deflectors 1 to project into the working apertures to a length which is approximately equal to the length of the bristles 10 of the brush rollers 6.

The carpet deflectors 1 do not impede the insertion or extraction of the brush rollers 6. With the carpet deflectors designed in this way in accordance with the invention the entire process is far simpler and quicker than in all floor cleaning apparatus hitherto available on the market. The cost of inserting the brush rollers when the apparatus is being assembled at the manufacturing stage is likewise considerably reduced.

The invention may be embodied in other specific forms without departing from the spirit or essential characteristics thereof. The embodiment is therefore to be considered in all respects as illustrative and not restrictive.

What is claimed is:

1. Floor cleaning apparatus comprising:

(a) a housing including means defining a lower substantially planar surface arranged to face the floor;

(b) at least one elongated recess in said means defining said lower surface of said housing;

(c) an elongated brush roller rotatably mounted in said at least one recess in said means defining said lower surface of said housing and having bristles projecting radially about its periphery and continuously along substantially its entire axial length, said brush roller being positioned in said at least one recess such that the bristles on the underside of said brush roller project below said lower substantially planar surface to contact the floor;

(d) drive means connected to said brush roller for rotating said brush roller in only one predetermined rotary direction such that said bristles pass through a cylindrical path about said brush roller and enter the interior of said at least one recess along one side of said at least one recess; and (e) a plurality of spaced carpet deflectors projecting, substantially horizontally along said one side of said at least one recess, from said means defining said lower substantially planar surface into said annular path of said bristles towards said brush roller, the free ends of said plurality of spaced deflectors being spaced from the periphery of said brush roller, to prevent corners or edges of a carpet from being pushed into said at least one recess by said rotating brush roller;

(f) whereby no unbrushed streaks can be produced on the floor since the bristles in contact with the floor do not have spaced gaps therebetween caused by said deflectors at said spaced locations along said one side of said at least one recess and said brush roller may be removed from said at least one recess without first removing said plurality of deflectors.

2. The floor cleaning apparatus as claimed in claim 1 wherein said plurality of carpet deflectors project substantially in the plane of said substantially planar surface into said annular path of said bristles to a length which is approximately equal to the length of said bristles of said brush roller.

* * * * *